US011148067B1

(12) United States Patent
Maritato

(10) Patent No.: US 11,148,067 B1
(45) Date of Patent: Oct. 19, 2021

(54) UNFOLDING SPRINGING AMUSEMENT APPARATUS

(71) Applicant: Tekky, Orland Park, IL (US)

(72) Inventor: Mitch Maritato, Germantown, WI (US)

( * ) Notice: Subject to any disclaimer, the term of this patent is extended or adjusted under 35 U.S.C. 154(b) by 0 days.

(21) Appl. No.: 17/234,680

(22) Filed: Apr. 19, 2021

(51) Int. Cl.
*A63J 21/00* (2006.01)
*A63J 19/00* (2006.01)
*A63H 37/00* (2006.01)

(52) U.S. Cl.
CPC ..... *A63J 19/006* (2013.01)

(58) Field of Classification Search
CPC ..... A63J 21/00; A63H 13/00; A63H 13/02; A63H 17/008; A63H 37/00
USPC ..... 472/51–55, 135; 446/308–310
See application file for complete search history.

(56) References Cited

U.S. PATENT DOCUMENTS 1,580,040 A * 4/1926 Hasbrouck ..... A63F 9/00 472/53
3,586,320 A * 6/1971 Mace ..... A63H 33/00 472/54
4,323,238 A * 4/1982 Jernstrom ..... A63F 9/12 273/450
5,584,741 A * 12/1996 Cheung ..... A63H 3/28 40/414
RE46,087 E 8/2016 Wirt

FOREIGN PATENT DOCUMENTS

CN 201423166 Y 3/2010
GB 1352365 A 5/1974

OTHER PUBLICATIONS

Espacenet translation of Liang, Zhongming, Mechanical frog toy, Chinese utility model No. CN201423166, Mar. 17, 2010.

* cited by examiner

*Primary Examiner* — Kien T Nguyen
(74) *Attorney, Agent, or Firm* — Dixon IP Law; Jeffrey S. Dixon

(57) ABSTRACT

An unfolding springing apparatus comprises a base, an apparatus linkage comprising cranks and coupler links connected to the base, an unfolding spring, a drive motor, a transmission, and a prop mount. The apparatus linkage includes one or a plurality of opposed pairs of cranks, each pair of cranks being connected to each other at their respective ends by a pair of pivotally connected coupler links. The unfolding spring is operative to bias the apparatus linkage to unfold. The drive motor is operative to fold the apparatus and to reenergize the unfolding spring. The transmission includes a linear extension module. When engaged, the transmission transmits displacement of the drive motor to the apparatus linkage to fold the linkage. When disengaged, the transmission releases the apparatus linkage to be unfolded by the unfolding spring. The transmission includes a motorized clutch module.

16 Claims, 14 Drawing Sheets

UNFOLDING SPRINGING AMUSEMENT APPARATUS

FIELD OF THE DISCLOSURE

The present disclosure relates to an unfolding springing amusement apparatus that produces a sudden movement of a prop, for a startle, scare, and/or amusement effect. More particularly, the unfolding springing apparatus may produce light and/or sound effects coordinated with the sudden movement to enhance the effect of the sudden movement. Still more particularly, the apparatus may produce such movement and effects in response to detecting motion and/or sound, so as to surprise a person approaching or passing near the apparatus.

SUMMARY

In one aspect, an unfolding springing apparatus is disclosed. The unfolding springing apparatus comprises a base, an apparatus linkage, an unfolding spring, a drive motor, a transmission, and a prop mount. The base is adapted and configured to be supported on a support, the unfolding springing apparatus being adapted and configured to be supported by the base. The apparatus linkage comprises a plurality of interconnected links, the apparatus linkage being articulable from a folded position to an unfolded position, the apparatus links comprising the base, a first crank, a second crank, a third crank, a fourth crank, a first coupler link, a second coupler link, and a third coupler link. Each of the first crank and the second crank is pivotally connected to each of the base and the first coupler link, each of the first crank and the third crank being pivotally connected to each of the first coupler link and the second coupler link, each of the third crank and the fourth crank being pivotally connected to each of the second coupler link and the third coupler link. The unfolding spring is operatively connected between a pair of the apparatus links so as to bias the apparatus linkage to articulate in an unfolding direction from a folded position toward an unfolded position. The drive motor is operatively connected between a first one of the links and a second one of the links. The transmission is operatively connected between the drive motor and the second one of the links and adapted and configured to be engageable when the apparatus linkage is in the unfolded position, when engaged, to transmit displacement from the drive motor to the second link, so as to move the second link relative to the first link, so as to cause the apparatus linkage to articulate in a folding direction from the unfolded position to the folded position. The transmission is further adapted and configured to be disengageable when the apparatus linkage is in the folded position, and, when disengaged, to permit the apparatus linkage to articulate independently of the drive motor in the unfolding direction from the folded position to the unfolded position. In embodiments, the transmission is adapted and configured to be disengageable at any position of the apparatus linkage, and whether the drive motor is energized or at rest. The prop mount is connected to the apparatus linkage such that at least the first crank and the second crank are connected between the base and the prop mount.

In another aspect, an unfolding springing apparatus comprises a base, an apparatus linkage, an unfolding spring, a drive motor, a transmission, and a prop mount. a base. The base is adapted and configured to be supported on a support, the unfolding springing apparatus being adapted and configured to be supported by the base. The apparatus linkage is articulable from a folded position to an unfolded position and comprises a first crank, a second crank, and a coupler link, each of the first crank and the second crank being pivotally connected to each of the base and the coupler link. The unfolding spring is operatively connected to the apparatus linkage so as to bias the apparatus linkage to articulate in an unfolding direction from a folded position toward an unfolded position. The drive motor is operatively connected between a first one of the links and a second one of the links. The transmission is operatively connected between the drive motor and the second one of the links and adapted and configured to be engageable when the apparatus linkage is in the unfolded position, when engaged, to transmit displacement from the drive motor to the second link, so as to move the second link relative to the first link, so as to cause the apparatus linkage to articulate in a folding direction from the unfolded position to the folded position, the transmission being adapted and configured to be disengageable when the apparatus linkage is in the folded position, and, when disengaged, to permit the apparatus linkage to articulate independently of the drive motor in the unfolding springing direction from the folded position to the unfolded position. The prop mount is connected to the apparatus linkage such that at least the first crank and the second crank are connected between the base and the prop mount. The transmission includes an extension cylinder, an extension rod, and an output gear. The extension cylinder is pivotally mounted to the base. The extension rod has a length and a linear tooth rack comprising longitudinally distributed driven teeth, the extension rod being slidably connected to the extension cylinder to permit movement of the extension rod relative to the extension cylinder in opposed first and second longitudinal directions. The extension rod has a proximal end disposed in the extension cylinder and a distal end pivotally connected to an input crank, the input crank being one of the first crank and the second crank, such that articulation of the apparatus linkage in the unfolding direction causes rotation of the input crank in an unfolding direction that produces movement of the extension rod in the first longitudinal direction, and such that movement of the extension rod in the second longitudinal direction produces rotation of the input crank in a folding direction that causes the apparatus linkage to articulate in the folding direction. The output gear is operatively connected to the drive motor to be rotated in a drive direction by the drive motor when the drive motor is displaced, the output gear having drive teeth that mesh with the driven teeth of the extension rod such that rotation of the output gear in a drive direction causes the extension rod to move in the second longitudinal direction. The first longitudinal direction may be a direction in which the extension rod is adapted and configured to extend from the extension cylinder, the second longitudinal direction then being a direction in which the extension rod is adapted to configured to retract into the extension cylinder.

In another aspect, an unfolding springing apparatus comprises a base, an apparatus linkage, an unfolding spring, a drive motor, a transmission, and a prop mount. The base is adapted and configured to be supported on a support, the unfolding springing apparatus being adapted and configured to be supported by the base. The apparatus linkage is articulable from a folded position to an unfolded position and comprises a first crank, a second crank, and a coupler link, each of the first crank and the second crank being pivotally connected to each of the base and the coupler link. The unfolding spring is operatively connected to the apparatus linkage so as to bias the apparatus linkage to articulate in an unfolding direction from a folded position toward an unfolded position. The drive motor is operatively connected between a first one of the links and a second one of the links. The transmission is operatively connected between the drive motor and the second one of the links and adapted and configured to be engageable when the apparatus linkage is in the unfolded position, when engaged, to transmit displacement from the drive motor to the second link, so as to move the second link relative to the first link, so as to cause the apparatus linkage to articulate in a folding direction from the unfolded position to the folded position. The transmission is further adapted and configured to be disengageable when the apparatus linkage is in the folded position, and, when disengaged, to permit the apparatus linkage to articulate independently of the drive motor in the unfolding springing direction from the folded position to the unfolded position. The prop mount is connected to the apparatus linkage such that at least the first crank and the second crank are connected between the base and the prop mount. The transmission includes a drive geartrain and a clutch mechanism. The drive geartrain comprises a plurality of drive gears that are adapted and configured to be meshed in series, the drive geartrain being operatively connected to the drive motor so that displacement of the drive motor in a drive direction causes rotation of the drive gears in respective drive directions when the transmission is engaged. The drive gears include an output gear and a clutch gear. The output gear is operatively connected to an input crank of the apparatus linkage, the input crank being one of the first crank and the second crank, such that rotation of the output gear in its respective drive direction causes the input crank to pivot in a folding direction that causes the apparatus linkage to articulate in the folding direction. The clutch gear is movably connected to the drive geartrain to permit displacement of the clutch gear relative to the drive geartrain to and from a disengaged position and an engaged position, wherein the transmission is engaged when the clutch gear is in the engaged position and disengaged when the clutch gear is in the disengaged position. The clutch gear in the disengaged position is unmeshed from at least one gear with which the clutch gear is meshed when in the engaged position, so that at least the output gear is permitted to rotate independently of displacement of the drive motor when the clutch gear is in the disengaged position. The clutch mechanism is operatively connected to the drive geartrain so as to be operable to displace the clutch gear to the disengaged position to disengage the transmission.

DETAILED DESCRIPTION

Figure 1:
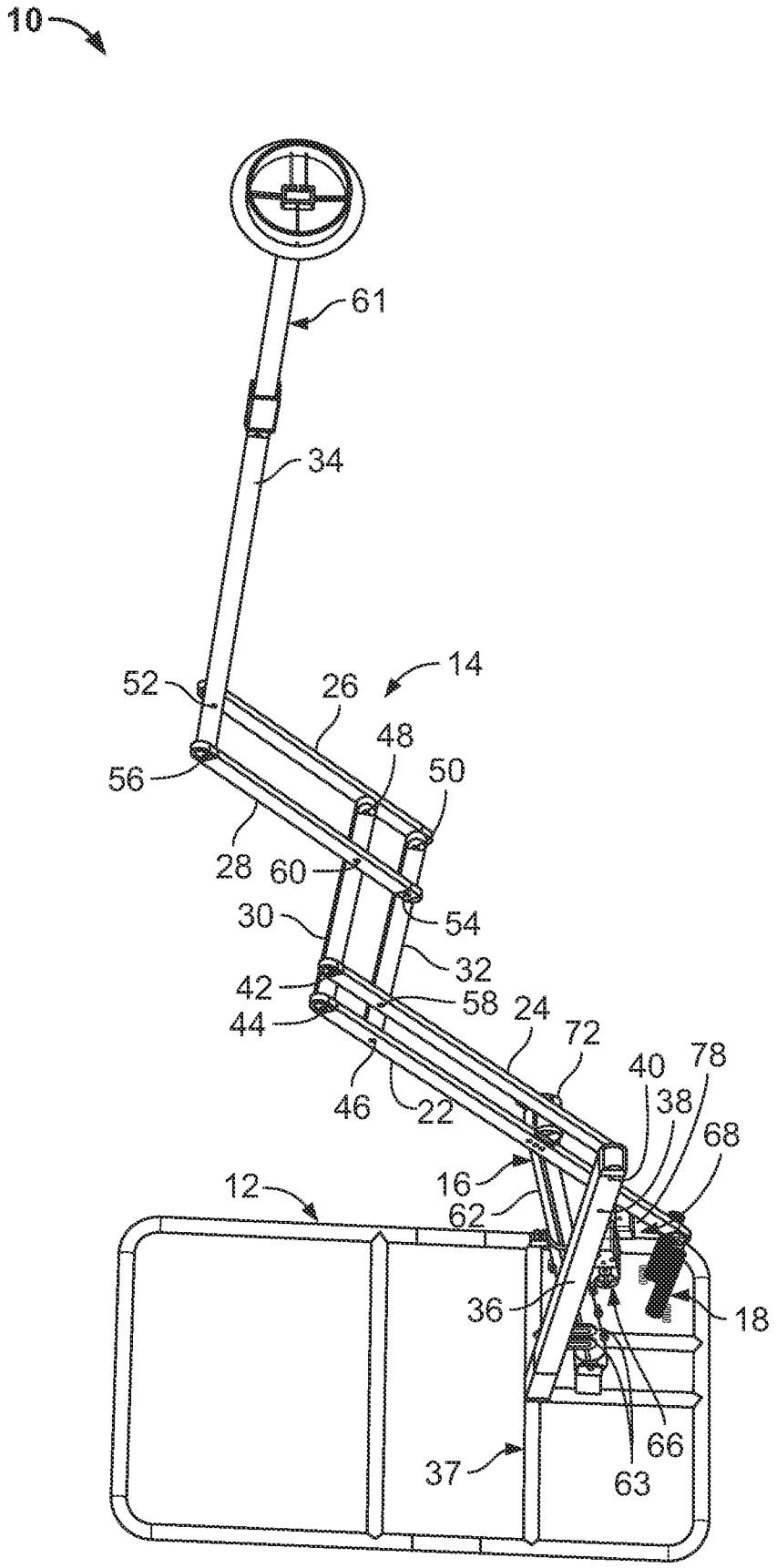
FIG. 1 is a top-left-rear perspective view of an unfolding springing apparatus in an unfolded position, according to an embodiment of the present disclosure.

Described in this section are unfolding springing amusement apparatuses according to the present disclosure. An embodiment of an unfolding springing amusement apparatus is more particularly described and illustrated in the accompanying drawings as an unfolding springing apparatus 10. The unfolding springing apparatus 10 comprises a base 12, an apparatus linkage 14, an extension module 16, an unfolding spring 18, and an electrical system 20.

The base 12 is adapted and configured to be supported on a support, the unfolding springing apparatus 10 being adapted and configured to be supported by the base 12. Specifically, the base 12 is a frame structure that is adapted and configured to rest or be secured and held stationary during normal operation of the unfolding springing apparatus 10, such as by suitable fasteners or weights (e.g., sandbags) (not shown), on a generally horizontal support surface (not shown), such as that of an indoor or outdoor floor, deck, patio, tabletop or countertop, grass lawn, driveway, street, sidewalk, or the like. Other suitable supports on which an apparatus according to the present disclosure may be supported may include non-horizontal supports, such as a wall, column, or upright member(s) of a frame structure, to which a base, such as the base 12 and/or a differently adapted and configured base of another embodiment, may be secured. Other suitable bases may be adapted and configured to be movably supported on a support. For example, in other embodiments of an unfolding springing apparatus according to the present disclosure, a base may be movably supported on a generally horizontal support surface by wheels, casters, bi- or omnidirectional rollers, runners, or glides.

The apparatus linkage 14 comprises a plurality of interconnected links, namely, the base 12, a first crank 22, a second crank 24, a third crank 26, a fourth crank 28, a first coupler link 30, a second coupler link 32, and a third coupler link 34. By "interconnected," it is meant that each link is connected to every other link, either directly or indirectly. Each link may be indirectly connected to one or more of the other links by way of one or more intervening links and/or by way of one or more series of intervening links. For example, as illustrated in the drawings, the base 12 is connected to a first crank 22 both directly and indirectly. The base 12 includes a fixed support column 36 fixedly connected to and extending upwardly from a base frame 37, the base frame 37 being adapted and configured to rest on a horizontally oriented support. The first crank 22 is connected to the fixed support column 36 directly at a first pivotal joint 38. Thus, the base 12 is connected to the first crank 22 indirectly via the second crank 24 and the first coupler link 30, the second crank 24 being directly connected to the base 12 at a second pivotal joint 40, the first coupler link 30 being directly connected to the second crank 24 at a third pivotal joint 42, and the first crank 22 being directly connected to the first coupler link 30 at a fourth pivotal joint 44. The first crank 22 is also pivotally connected to the second coupler link 32 at a fifth pivotal joint 46. The third crank 26 is pivotally connected to the first coupler link 30 at a sixth pivotal joint 48, to the second coupler link 32 at a seventh pivotal joint 50, and to the third coupler link 34 at an eighth pivotal joint 52. The fourth crank 28 is pivotally connected to the second coupler link 32 at a ninth pivotal joint 54 and to the third coupler link 34 at a tenth pivotal joint 56.

Optionally, as illustrated in FIGS. 1, 2, and 5-10, the second crank 24 is also pivotally connected to the second coupler link 32 at an eleventh pivotal joint 58, and the fourth crank 28 is also pivotally connected to the first coupler link 30 at a twelfth pivotal joint 60. While the first through tenth pivotal joints 38-56 are already sufficient to constrain all of the links of the apparatus linkage 14 to articulate together in a vertical plane of articulation (i.e., the vertical plane corresponding to the right and left side elevation views of the unfolding springing apparatus 10 shown in FIGS. 2, 6, 7 and 10), the eleventh and twelfth pivotal joints 58, 60 provide additional stability. Depending on the relative positioning of the first through tenth pivotal joints 38-56, the eleventh and twelfth pivotal joints 58, 60 may require additional degrees of freedom, as in the case of longitudinal slots on each link of the respective pair of connected links, with a common pin extending therethrough, to avoid binding the apparatus linkage 14. However, where, as illustrated, the first and second cranks 22, 24 are parallel, the first and second coupler links 30 and 32 are parallel, and the third and fourth cranks 26, 28 are parallel, the illustrated pivotal joints 58 and 60 to not impede articulation of the apparatus linkage 14.

Given that the links 22-34 are straight and of the same, uniform thickness dimension normal to the vertical plane of articulation of the apparatus linkage 14, further additional stability is provided by connecting the third and fourth cranks 26, 28 at opposite sides (depicted as right and left sides, respectively, though the reverse is also possible) of the first, second, and third coupler links 30, 32, 34. In other embodiments, respective third and fourth (or fifth and sixth, or a subsequent pair of) cranks may be connected at the same side of the respective set of coupler links.

Figure 10:
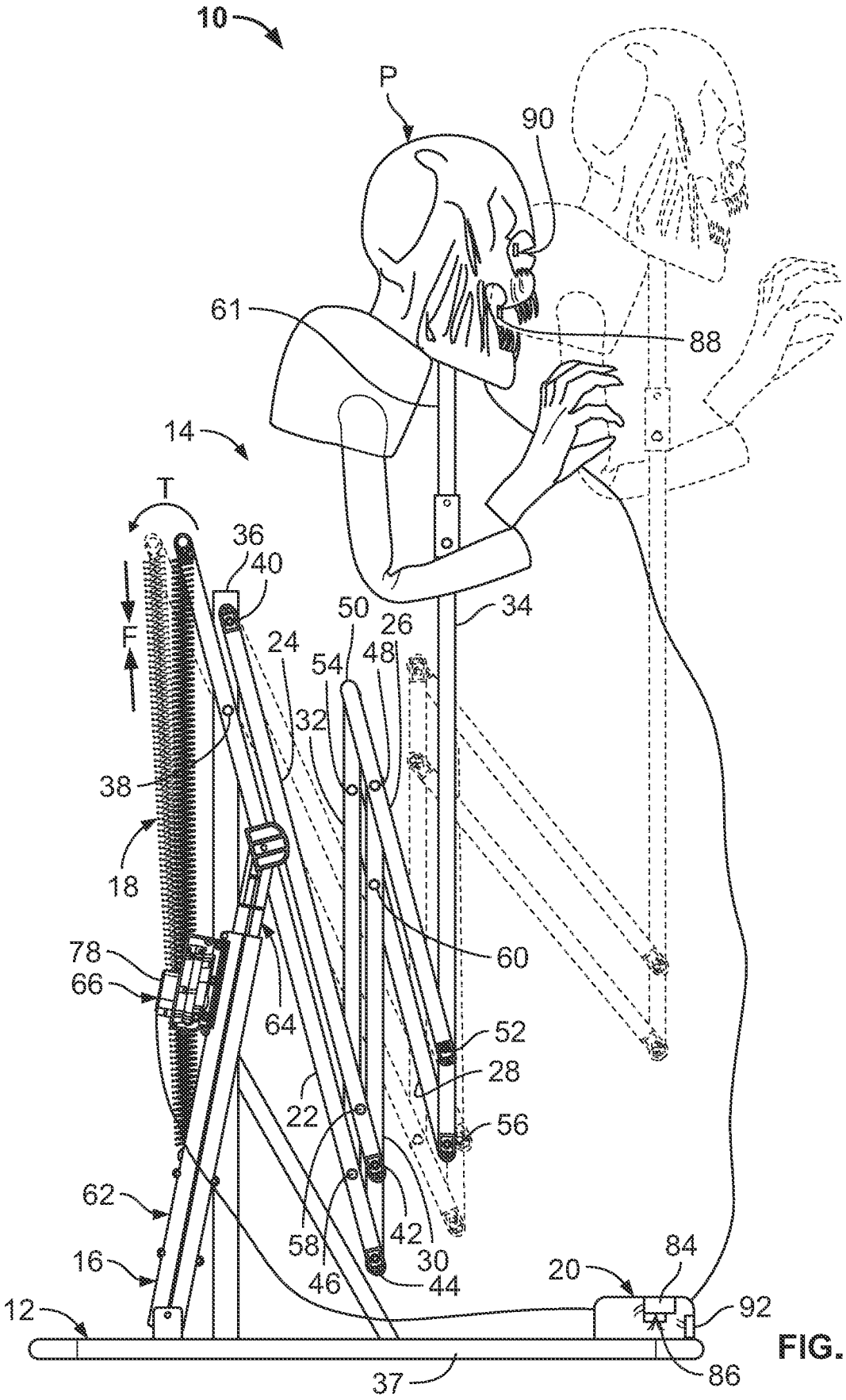
FIG. 10 is a right side elevation view of the unfolding springing apparatus shown in FIGS. 1-9, illustrating articulation of an apparatus linkage, and further showing a prop and an electrical system.

A prop mount 61, adapted and configured for fixedly mounting a prop P, illustrated in FIG. 10 as the head and raised hand(s) of a frightening figure, is fixedly connected to the third coupler link 34. In other embodiments, a prop may be a spider, ghost, clown, or any of various other animal and character forms. In still other embodiments, a prop mount may be fixedly connected to any of the movable apparatus links, or any of the movable apparatus links may comprise an integral prop mount for similarly fixedly mounting a prop. In the illustrated embodiment, the prop mount 61 includes a lower portion having an axis aligned with an axis of the third coupler link 34 and a transverse cross section perpendicular to the axis that is at least substantially identical to an at least substantially uniform transverse perpendicular cross section of the third coupler link 34, and an upper end portion having a different transverse perpendicular cross section. In other embodiments, a prop mount may have an at least substantially uniform cross section throughout its axial length, which is at least substantially identical to that of a link of an apparatus linkage to which it is coaxially connected, or of which it constitutes a portion.

In some embodiments, a prop is included with a draped piece of fabric (not shown), which may represent a cloak or other garment of the frightening figure, while also surrounding the apparatus on all sides. Such a draped piece of fabric can serve to hide its mechanical and electrical components, so as to enhance the surprise effect when the apparatus linkage springs to the unfolded position, causing sudden movement of the prop.

Embodiments in which the prop mount is connected to or comprised in a movable link that is indirectly connected to a fixed base by one or more intervening movable links can impart to a prop the combined movements of two or more links, allowing for interesting prop movement possibilities. Where, as in the illustrated embodiment, a prop mount is connected to a coupler link, that is, to a link that is connected to a stationary base by an even number of pivotal joints in series, the prop mount tends to move generally without rotating, to the extent that opposed pairs of coupler links and opposed pairs of cranks of a linkage are constrained to remain parallel. This may provide for lifelike movement of, for example, a prop that represents a body part that generally remains upright, such as a head. Where instead it is desired to impart tilting or rotating movement to a prop, a prop mount may instead be connected to a crank of a linkage, that is, to a link that is connected to a stationary base by an odd number of pivotal joints in series.

Figure 2:
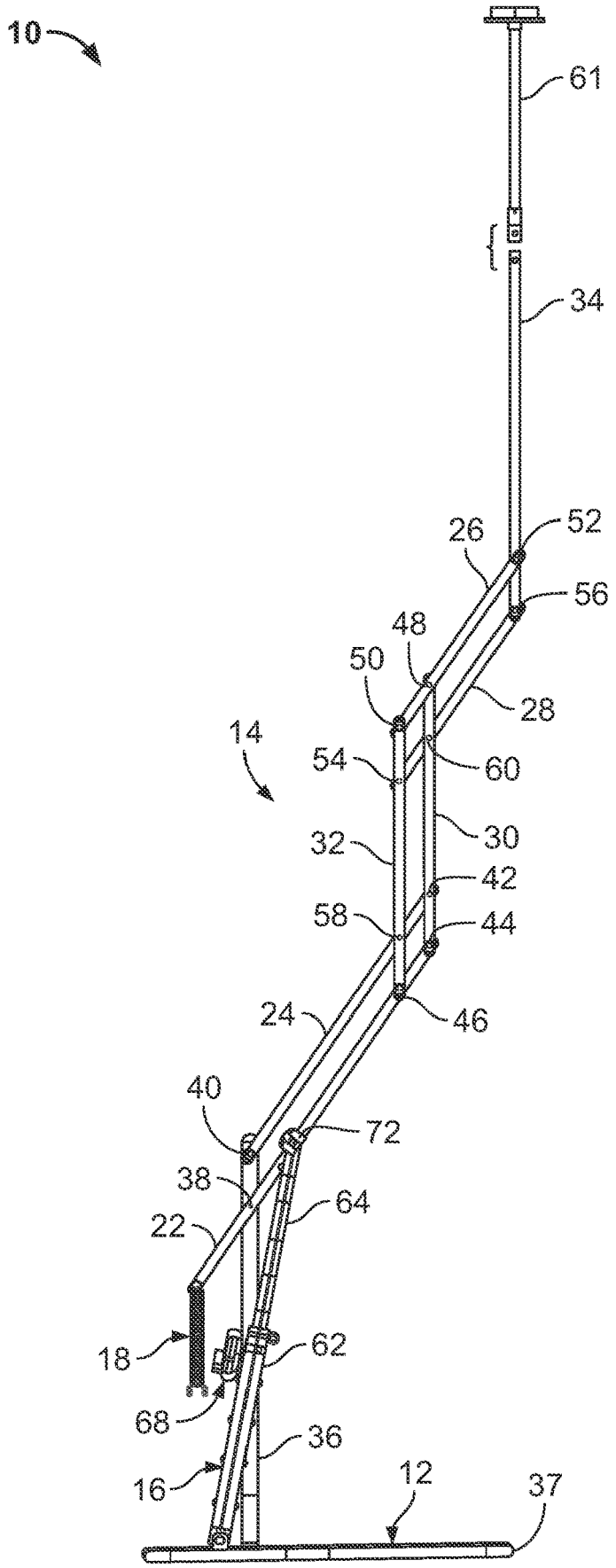
FIG. 2 is a right side elevation view of the unfolding springing apparatus shown in FIG. 1.

The apparatus linkage 14 is articulable in an unfolding direction from a folded position to an unfolded position and in a folding direction from the unfolded position to the folded position. The folded position of the apparatus linkage 14 is illustrated in FIGS. 5-10, and the unfolded position of the apparatus linkage 14 is illustrated in FIGS. 1 and 2. In the illustrated embodiment, the folded position is a position of the apparatus linkage 14 in which the prop mount 46 is vertically nearest to the base 12 throughout the range of articulation of the apparatus linkage 14, and the unfolded position is a position of the apparatus linkage 14 in which the prop mount 61 is vertically farthest from the base 12. In this manner, the prop P is connected so as to follow the movement of the third coupler link 34, thus lunging upwardly and initially forwardly when the transmission is disengaged and the apparatus linkage 14 begins to articulate, as illustrated in FIG. 10. When apparatus linkage 14 reaches a position in which the first, second, third, and fourth cranks 22-28 are oriented horizontally and continues to articulate in the unfolding direction, and the prop P continues to move upwardly while returning rearwardly. In other embodiments not shown, particularly those in which a base is supported on a wall or other vertically oriented support, a folded position may be a position of an apparatus linkage in which a prop is horizontally nearest to the base, and an unfolded position may be a position of the apparatus linkage in which the prop is horizontally farthest from the base.

Figure 11:
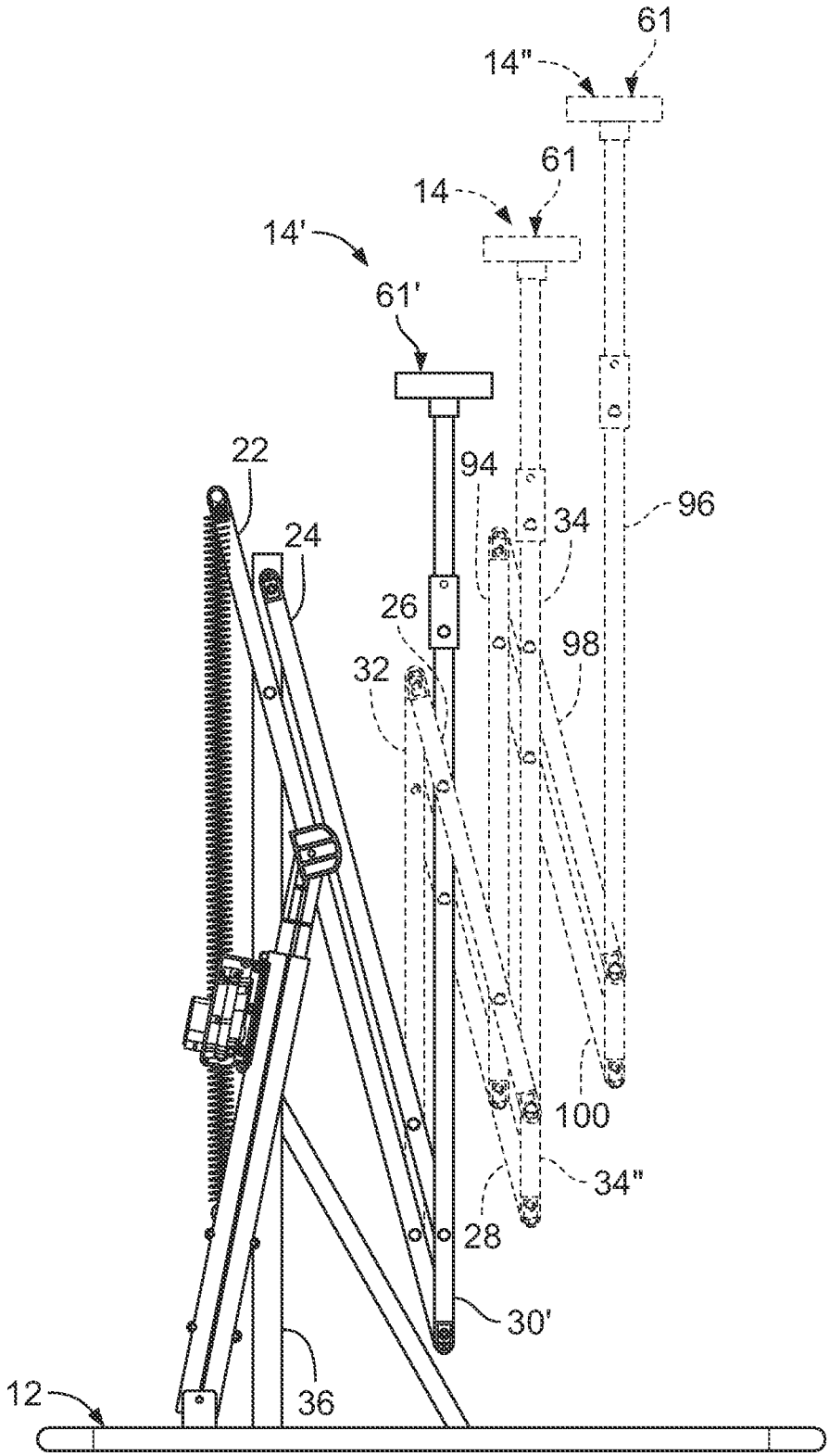
FIG. 11 is a right side elevation illustration of three superimposed embodiments of an unfolding springing apparatus.

Illustrated in FIG. 11 are three alternative embodiments of an unfolding springing apparatus according to the invention, each with a slightly different respective apparatus linkage 14', 14, and 14". In particular, the apparatus linkages 14', 14, and 14" of the three embodiments respectively include one, two, and three staged pairs of opposed cranks, the cranks pivotally connected at each of their ends either to a coupler link or to the fixed support column 36. Thus, a "one-stage" apparatus linkage 14', depicted in solid lines, is similar to the "two-stage" apparatus linkage 14 already described, but wholly excludes its "second stage" links, namely, the third and fourth cranks 26, 28 and the second and third coupler links 32, 34, while substituting a modified coupler link 30' in place of the first coupler link 30 of the two-stage apparatus linkage 14, to which the prop mount 61 is fixedly connected. Shown in phantom lines are the second stage links of the two-stage apparatus linkage 14, namely, the third and fourth cranks 26, 28 and the second and third coupler links 32, 34, which are excluded from the one-stage apparatus linkage 14'. Likewise, a three-stage apparatus linkage 14" will be understood to include the links of the two-stage apparatus linkage 14 or their equivalents (a shorter third coupler link 34" being included in lieu of the third coupler link 34), in addition to a set of third-stage links comprising a fourth coupler link 94, a fifth coupler link 96, a fifth crank 98, and a sixth crank 100, which are connected to one another and to the third and fourth cranks 26, 28 and the third coupler link 34 in the same manner in which the latter three links and the second coupler link 32 are connected to one another and to the first and second cranks 22, 24 and the first coupler link 30. An apparatus linkage of an unfolding spring apparatus according to the present disclosure can thus be extended iteratively by adding successive stages, each stage including a new pair of cranks flanked at their respective ends by a new pair of coupler links about which the cranks pivot, in such a way as to overlap the terminal coupler link and terminal crank pair of the previous iteration. The linkage may be extended an arbitrary number of times in this manner, within the limits of practical considerations, such as the additional power required of the unfolding spring and drive motor, as well as the increased instability, associated with adding each successive stage.

An unfolding spring of an unfolding springing apparatus according to the present disclosure is operatively connected between a pair of the apparatus links so as to bias an apparatus linkage to articulate in an unfolding direction from a folded position toward an unfolded position. In the illustrated embodiment, the unfolding spring 18 comprises a pair of helical tension springs connected between a rear end of the first crank 22 and a pair of spring mounting hooks 63 integral to the fixed support column 36 of the base 12, to transmit a biasing tension force F, and a resultant biasing torque T, from the base 12 to the first crank 22, as indicated in FIG. 10, which bias the apparatus linkage 14 to articulate in the unfolding direction. It will be understood that, in other embodiments, compression or torsion springs may be deployed as supplemental or alternative unfolding (or folding, as desired) springs, connected to an apparatus linkage in a suitable manner to produce a desired springing movement. An extension module may include an internal spring (e.g., a gas, solid compression, or solid tension spring) to spring bias the module to extend or to retract as desired, in conjunction with a motor that drives the module in the opposite direction to reset an apparatus linkage and recharge the spring.

In other embodiments of an unfolding springing amusement apparatus, a pneumatic component produces folding and unfolding articulation of an apparatus linkage at desired speeds, omitting an electromagnetic drive motor, a separate spring, and/or a clutch. In one embodiment, a suitable single acting pneumatic air cylinder component (not shown) drives a desired sudden articulation of an apparatus linkage when pressurized, while a return force from gravity or a return spring (which may be a separate spring component or part of the air cylinder component itself) reverses the articulation when air pressure is either entirely removed from the air cylinder component or sufficiently reduced to produce a an air cylinder force at a desired level less than that of the return force. In another embodiment, a pneumatic rotary actuator (not shown) drives the desired folding and unfolding apparatus linkage articulations, for example, by directly engaging a pivotal joint of the apparatus linkage. In another embodiment, a suitable dual acting pneumatic cylinder (not shown), activated by a compressor and a manual or solenoid valve or air switch, drives the desired folding and unfolding apparatus linkage articulations. Optionally, air output from the compressor may be limited by the compressor itself or by a separate pressure regulator. The dual acting pneumatic cylinder may have its speed of extension and retraction controlled by a flow control valve, to control the speed of apparatus linkage articulations. The dual acting pneumatic cylinder obviates the need for a brake or clutch, as the cylinder can drive bidirectional movements and can be pressurized rapidly enough to produce sudden "jumping" articulation even if it engages the apparatus linkage before it is fully pressurized. Finally, other forms of conserved potential energy, such as gravitational potential energy, could serve instead of spring potential energy as a passive driver of sudden apparatus linkage articulation. For example, weights could be hung from an input crank at a distance from its pivot point relative to a fixed base, to produce a desired biasing torque.

The extension module 16 operates to drive folding articulation of the apparatus linkage 14 and to hold the apparatus linkage 14 in the folded position, against the unfolding biasing force F and torque T, until its drive transmission is disengaged. The extension module 16 includes an elongate extension cylinder 62, an extension rod 64 movably mounted within the extension cylinder 62, a drive module 66 housed in a drive housing 78 mounted to the extension cylinder 62, and a clutch module 68 housed in a clutch housing 81 mounted to the extension cylinder 62. The extension rod 64 is slidably retained in the extension cylinder 62 so as to be movable longitudinally relative to the extension cylinder 62, and pivotally connected to the first crank 22 by a pivotal joint 70 provided by a connecting bracket 72.

The range of motion of the extension rod 64 relative to the extension cylinder 62 extends in an extension direction from a bottomed-out, retracted position shown in FIGS. 5-9 to a topped-out, extended position shown in FIGS. 1 and 2. The extension cylinder 62 retains the extension rod 64 in such a manner as to obstruct and prevent further movement of the extension rod 64 in the extension direction beyond the topped-out, extended position, thus defining the unfolded position of the apparatus linkage 14, by providing a stop to unfolding articulation of the apparatus linkage 14 past the unfolded position. In other embodiments, an unfolding stop may be provided in another suitable form, such as by the unfolding spring and/or the apparatus linkage itself having an intrinsically limited range of movement. When the apparatus linkage 14 is in the unfolded position and the base 12 rests on a horizontal support, an upper end of the prop mount 61 may, for example, be disposed at least seven feet above the horizontal support, preferably at least 8 feet above the horizontal support, and more preferably at least 9 feet above the horizontal support, so that the prop P springs to a dramatic height over the head of an average human observer near the unfolding springing apparatus 10. In other embodiments, a base frame may be mounted to a vertical support and aligned vertically, so that a prop springs forward toward a viewer to elicit a reaction. In still other embodiments, a base frame may be mounted horizontally but in an inverted position (e.g., to a ceiling), so that a prop, such as a spider, springs downward toward or in front of a viewer.

In still other embodiments, the unfolding springing apparatus 10 may be configured to operate in reverse as a folding springing apparatus. In particular, the unfolding spring 18 may be replaced by a folding spring (not shown), which may be a compression spring, such as a compressed gas or solid-state spring cylinder assembly, mounted between the same connection points as the unfolding spring 18, so as to bias the apparatus linkage 14 in the folding direction. In this manner, a rearward-facing prop mounted to the prop mount 61 (again, for example, a spider) would spring downwardly and, toward the end of its movement, rearwardly, from an unfolded position to a folded position, to give a viewer facing the rear of the apparatus 10 that the prop is jumping down and toward the viewer from above. Alternatively, in the same reverse configuration of the apparatus 10, a forward-facing prop mounted to the prop mount 61 may give the viewer the impression that a figure represented by prop is rapidly recoiling from the viewer, which may, for example, produce a comical effect. In either case, the drive motor 74 (introduced below) would then be operated in reverse to rotate the output gear 82 in a reverse drive direction opposite to the illustrated drive direction D (see FIG. 3), so as to extend the extension rod 64 in the extension direction E, to unfold the apparatus linkage 14 and recharge the folding spring with folding potential energy for a subsequent springing stroke in the folding direction. The ready adaptability of the unfolding springing apparatus 10 thus to operate, instead, as a folding springing apparatus, is partly facilitated by the clutch module 68 being driven by a clutch motor 83 that operates independently of the operation of the drive motor 74 and independently of the position of the apparatus linkage 14. The clutch module 68 is thus operable to disengage or engage the drive geartrain 76 (introduced below) at any desired time or position, thereby releasing or beginning to recharge the unfolding or folding potential energy of an unfolding or folding spring, whichever happens to be deployed in the apparatus 10.

The drive module 66 includes a drive motor 74, a transmission comprising a drive geartrain 76 operatively connected to the drive motor 74, the drive geartrain 76 in turn being operatively connected to the extension rod 64. The drive motor 74 is operable to fold the apparatus linkage 14, that is, to articulate the apparatus linkage 14 in the folding direction from the unfolded position to the folded position, while returning potential energy to the unfolding spring 18. The potential energy returned to the unfolding spring 18 may then be harnessed later to unfold the apparatus linkage, when the drive geartrain 76 is disengaged, as described further below. In the illustrated embodiment, the drive motor 74 is housed within a drive housing 78, the position of its rotor being shown in FIG. 3 and designated 74. The drive motor 74 may comprise an electric motor having a stator that is fixed with respect to the drive housing 78 and a rotor that operatively engages the drive geartrain 76. In other embodiments not shown in the figures, an unfolding springing apparatus may comprise a suitable motive element, including but not limited to a linear or torsion spring, an electric linear actuator, that is operable to fold the apparatus linkage 14 and reenergize the unfolding spring 18.

A drive motor of an unfolding springing apparatus according to the present disclosure is operatively connected between a first one of the apparatus links and a second one of the apparatus links. In the illustrated embodiment, the drive motor 74 is indirectly connected to each of the base 12 and the first crank 22, the first crank 22 serving as an input crank of the apparatus linkage 14 with respect to the base 12. In particular, the drive motor 74 is operatively connected to the base 12 by way of being fixedly mounted in the drive housing 78, the drive housing 78 being fixedly connected to the extension cylinder 62, and the extension cylinder 62 being pivotally mounted to the base 12. In addition the drive motor 74 is operatively connected to the first crank 22 by way of its rotor being operatively connected to the drive geartrain 76, which is in turn operatively connected to the extension rod 64 so as to retract the extension rod 64 when the drive motor 74 is energized and the drive geartrain 76 is engaged, as described further below.

Figure 3:
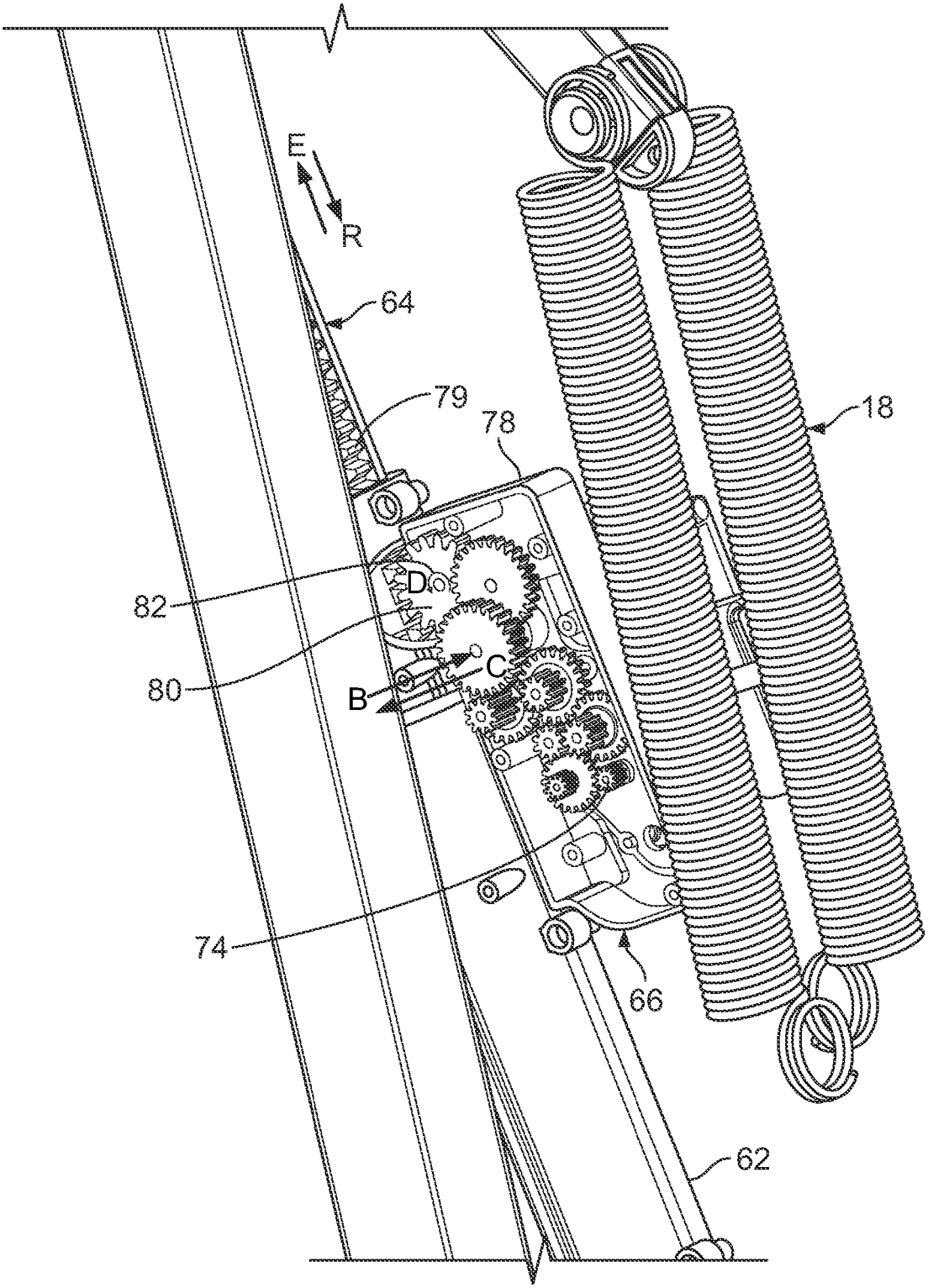
FIG. 3 is a truncated perspective view illustrating a drive gear train of the unfolding springing apparatus shown in FIG. 1.

The extension rod 64 has a length and a linear tooth rack 79, shown in FIG. 3, comprising longitudinally distributed driven teeth. The extension rod 64 is slidably connected to the extension cylinder 62 to permit extension and retraction of the extension rod 64 in opposed longitudinal extension and retraction directions E and R, as denoted in FIGS. 3 and 4. The extension rod 64 has a proximal end disposed in the extension cylinder and a distal end pivotally connected to the first crank 22, which, as mentioned above, functions as an input crank to drive articulation of the apparatus linkage 14 with respect to the base 12. (In other embodiments of a folding springing apparatus according to the present disclosure, an input crank of an apparatus linkage may be a crank analogous to the second crank 24.) Articulation of the apparatus linkage 14 in the unfolding direction causes rotation of the first crank 22 in an unfolding direction, which produces extension of the extension rod 64, which is stopped in the unfolded position depicted in FIGS. 1 and 2 by a suitable obstruction (not shown) in the extension cylinder 62 that prevents further extension of the extension rod 64. Conversely, retraction of the extension rod 64 produces rotation of the first crank 22 in a folding direction that causes the apparatus linkage 14 to articulate in the folding direction.

Generally, an extension module may refer to a module comprising a sliding linkage of an extension rod and an extension cylinder, the extension module being pivotally connected between a pivotally connected pair of links of an apparatus linkage, so that unfolding articulation of the apparatus linkage causes the extension rod to move in a first longitudinal direction relative to the extension cylinder, and so that movement of the extension rod in a second longitudinal direction relative to the extension cylinder, opposite the first, causes folding articulation of the apparatus linkage. Thus, in other embodiments not shown, instead of being connected to an apparatus linkage so that unfolding of the linkage causes the extension rod to extend, an extension module may be connected between a pair of apparatus links in such a manner that extension of the extension rod causes an apparatus linkage to fold, and unfolding of the apparatus linkage causes the extension rod to retract. For example, the unfolding springing apparatus 10 could be modified for connecting an extension module in this manner by having first and second pivotal joints positioned lower on a fixed support column, or including a taller fixed support column, and pivotally connecting a distal end of the extension module to a joint positioned somewhere along the first or second crank and a proximal end of the extension module to a joint on the fixed support column above the respective first or second pivotal joint, so that the connected crank pivots towards the proximal end of the extension module when the apparatus linkage unfolds.

As noted above, the transmission of the illustrated embodiment includes the drive geartrain 76. The drive geartrain 76 includes a plurality of spur-type drive gears, adapted and configured to be meshed in series, that includes a clutch gear 80 and an output gear 82, the output gear 82 engaging the extension rod 64. In other embodiments not shown in the drawings, a transmission may comprise other types of meshed drive gears and/or one or more cams. The drive geartrain 76 is operatively connected to the drive motor 74 so that displacement of the drive motor in a drive direction causes rotation of the drive gears in respective drive directions when engaged. The drive geartrain 76 is engageable when the apparatus linkage 14 is in the unfolded position, and when engaged, is adapted and configured to transmit displacement from the drive motor 74 to the first crank 22, so as to pivot the first crank 22 relative to the base 12, so as to cause the apparatus linkage 14 to articulate in a folding direction from the unfolded position to the folded position. More particularly, when the drive geartrain 76 is engaged, the output gear 82 is rotated in a drive direction D (indicated in FIG. 3) by the drive motor 74 when the drive motor 74 is displaced. The output gear 82 has drive teeth that mesh with the driven teeth of the tooth rack 79 of the extension rod 64, such that rotation of the output gear 82 in the drive direction D causes the extension rod 64 to retract, which in turn causes the first crank 22 to pivot in a folding direction that causes the apparatus linkage 14 to articulate in the folding direction.

Figure 4:
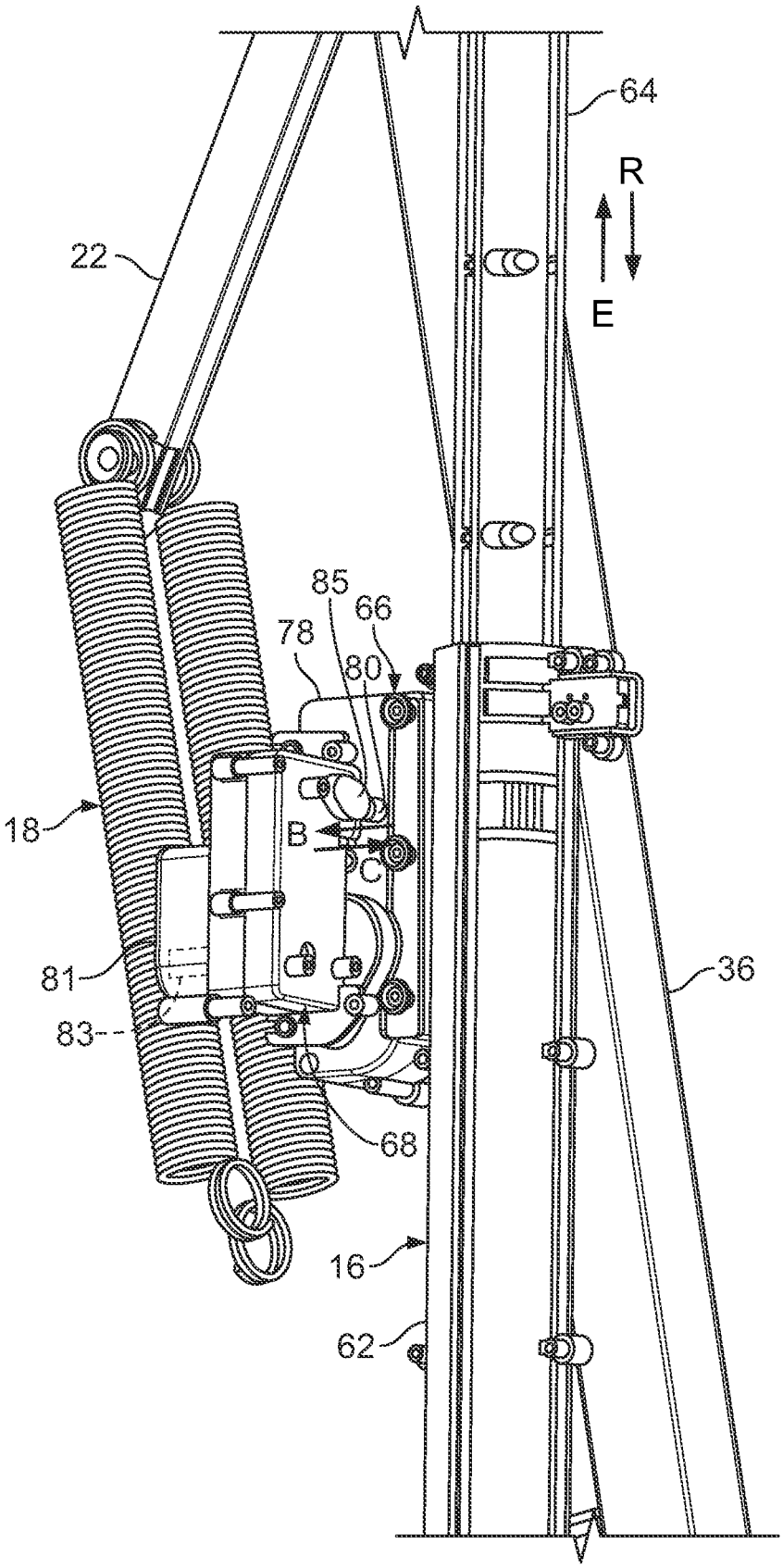
FIG. 4 is a truncated perspective view illustrating a clutch module of the unfolding springing apparatus shown in FIG. 1.
Figure 5:
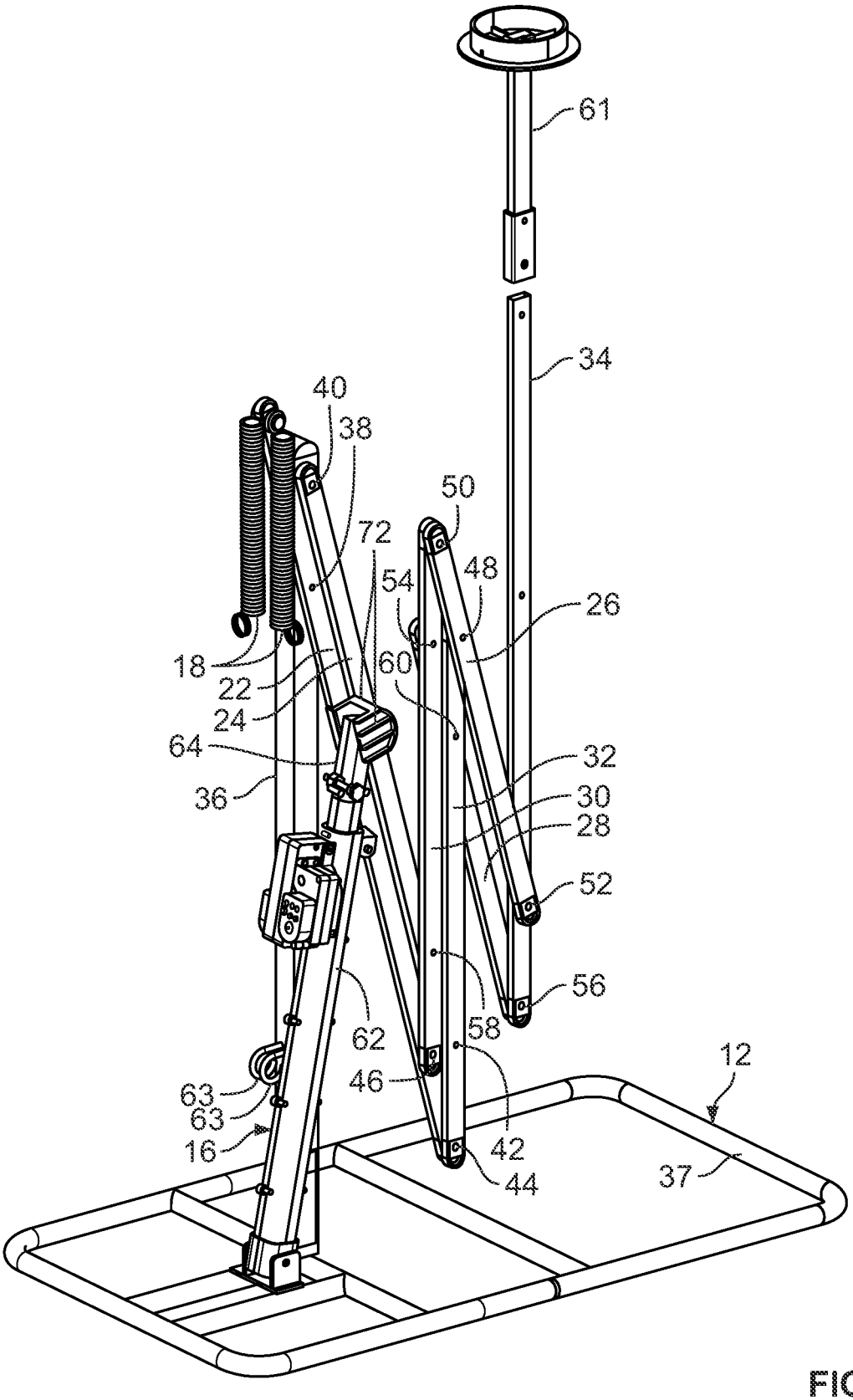
FIG. 5 is a top-right-rear perspective view of the unfolding springing apparatus shown in FIG. 1, in a folded position.
Figure 6:
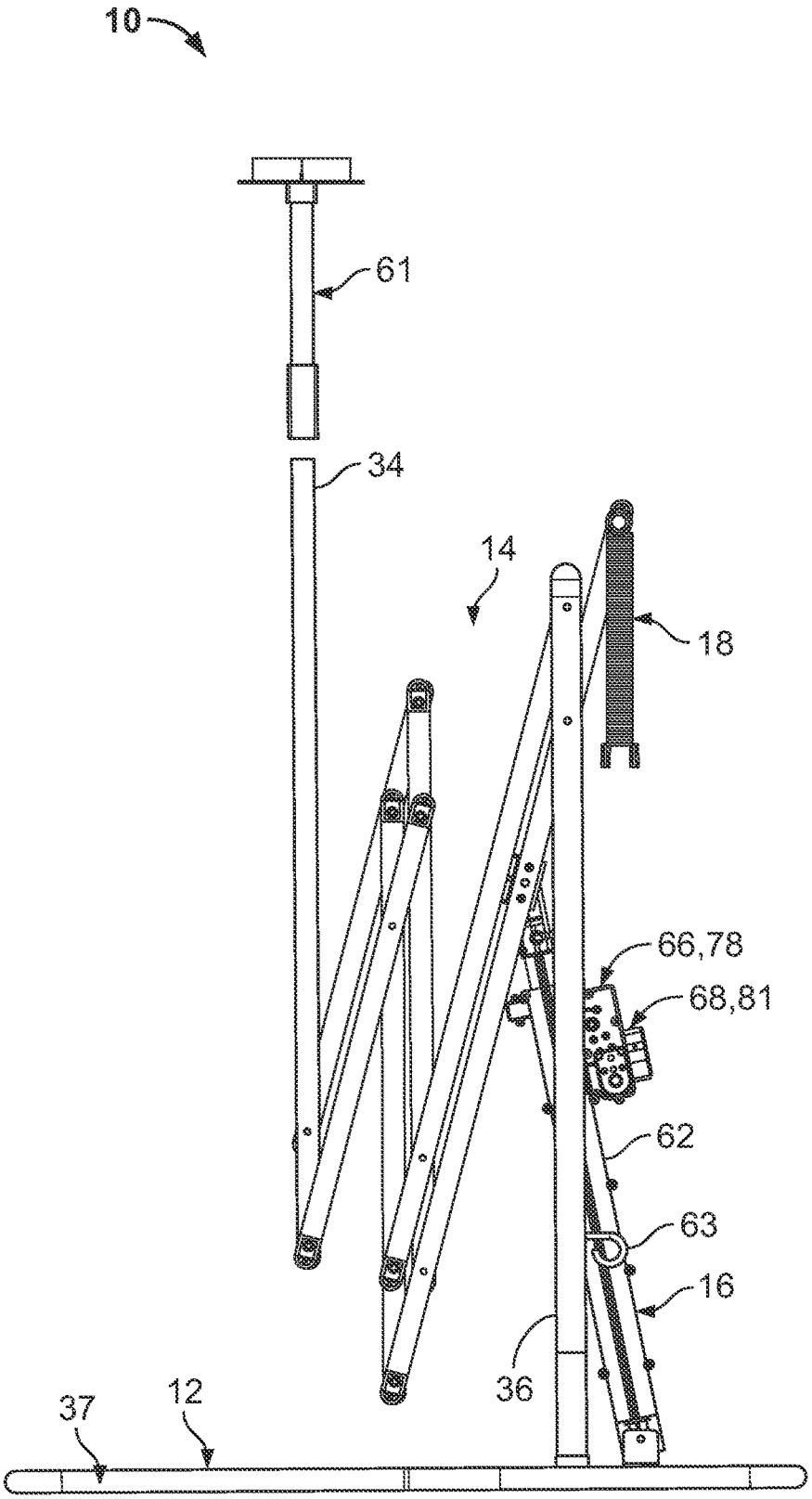
FIG. 6 is a left side elevation view of the unfolding springing apparatus as shown in FIG. 5.
Figure 7:
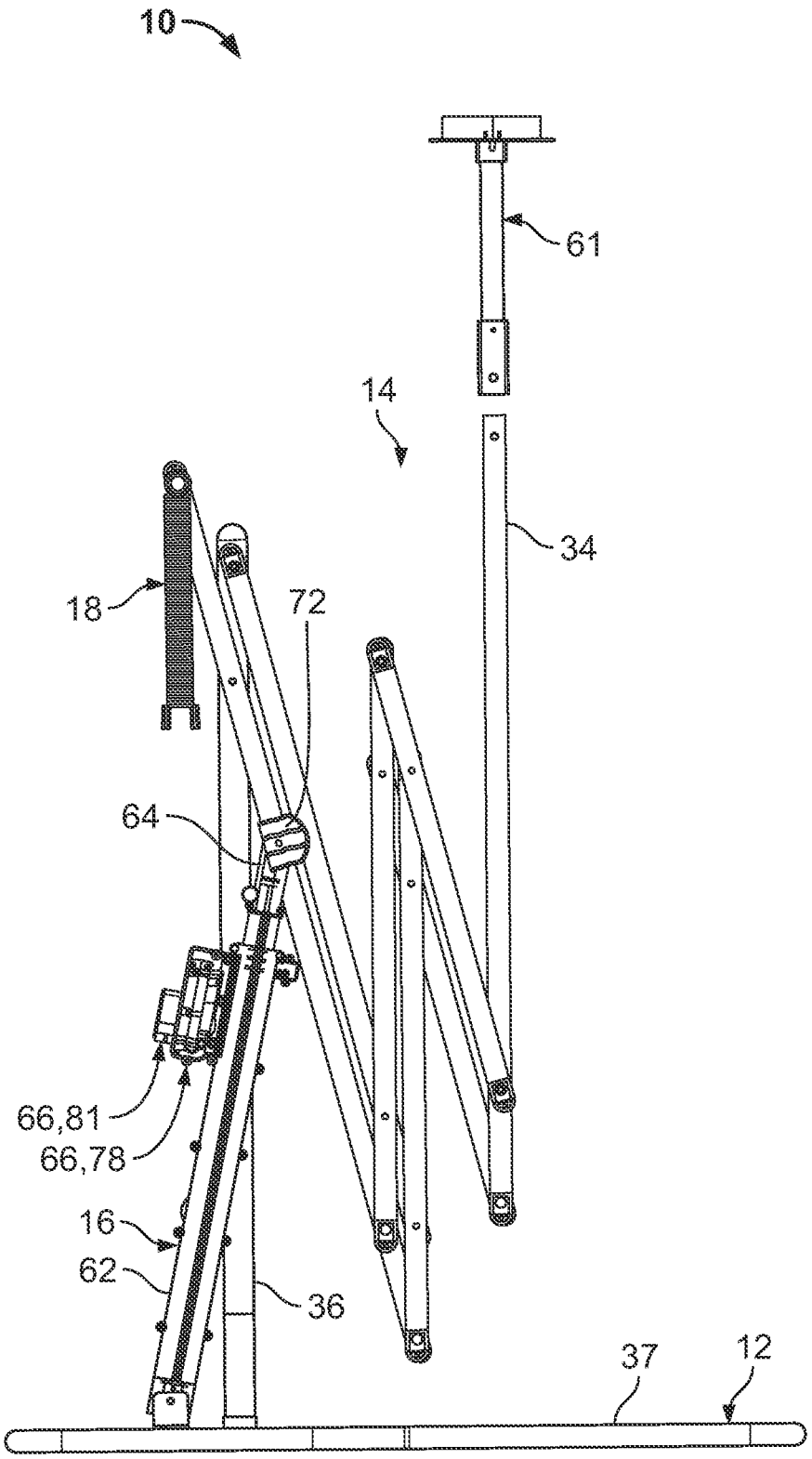
FIG. 7 is a right side elevation view of the unfolding springing apparatus as shown in FIG. 5.
Figure 8:
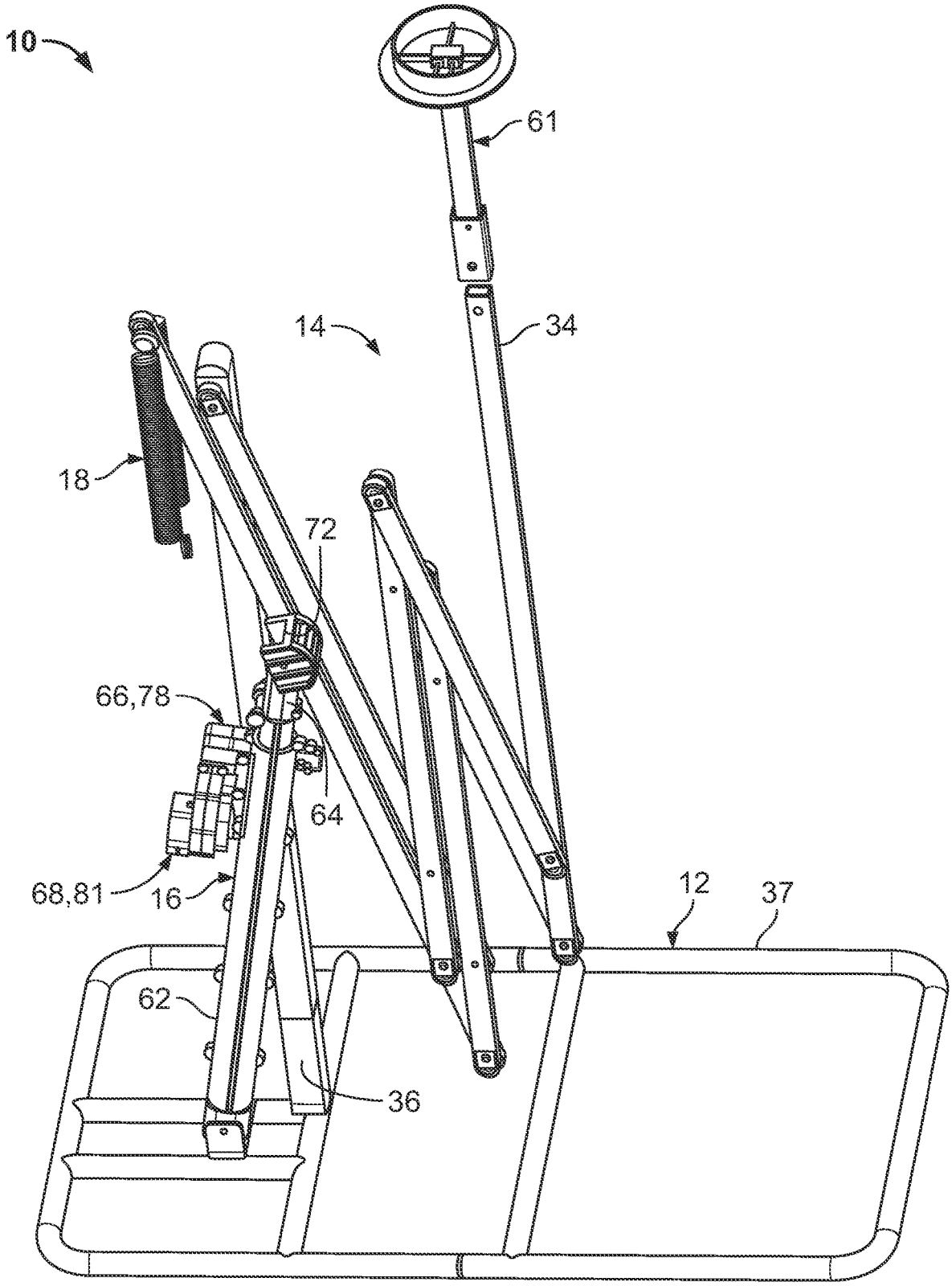
FIG. 8 is a top-front-right perspective view of the unfolding springing apparatus as shown in FIG. 5.
Figure 9:
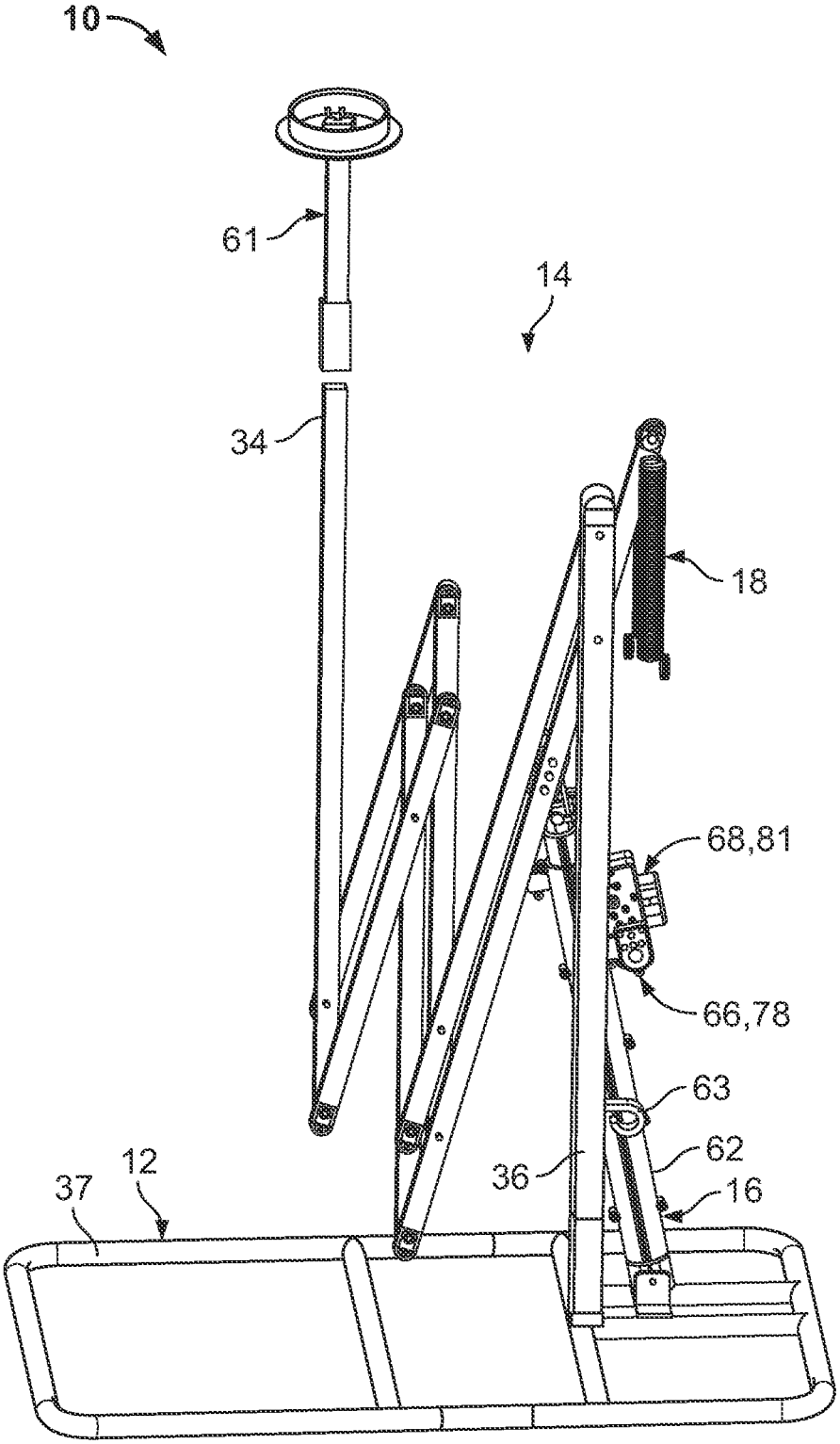
FIG. 9 is a top-front-left perspective view of the unfolding springing apparatus as shown in FIG. 5.

The clutch gear 80 is movably mounted to the drive housing 78 to permit axial displacement (in a biased direction B and an opposed camming direction C labeled in FIGS. 3 and 4) of the clutch gear 80 relative to the drive geartrain 76 to and from a disengaged position and an engaged position, wherein the transmission (i.e., the drive geartrain 76) is engaged when the clutch gear 80 is in the engaged position and disengaged when the clutch gear 80 is in the disengaged position. The clutch gear 80 in the disengaged position is operatively disconnected from at least one of the drive motor 74 and the first crank 22. In the illustrated embodiment, the clutch gear 80 in the disengaged position is unmeshed from an intermediate gear of the drive geartrain 76 that is driven by the clutch gear. In other embodiments, when disengaged, a clutch gear may unmesh from a drive motor shaft gear, or from another gear of a drive geartrain that drives the clutch gear. In the illustrated embodiment, the output gear 82 is permitted to rotate independently of displacement of the drive motor 74 when the clutch gear 80 is in the disengaged position. In other embodiments, an output gear may also act as a clutch gear, being permanently engaged to a drive motor, but being adapted and configured to retract radially into a drive housing to disengage from a driven member (analogous to the tooth rack 79) outside the drive housing.

The drive geartrain 76 is disengageable when the apparatus linkage 14 is in the folded position, and, when disengaged, is adapted and configured to permit the apparatus linkage 14 to articulate independently of the drive motor 74 in the unfolding direction from the folded position to the unfolded position.

An unfolding springing apparatus according to the present disclosure further comprises a disengagement mechanism for disengaging the drive mechanism from the apparatus linkage, to permit the apparatus linkage to suddenly unfold under the influence of the unfolding biasing force and resultant torque. In the illustrated embodiment, the disengage mechanism comprises the clutch module 68 housed in a clutch housing 81. The clutch module 68 comprises a clutch motor 83 operatively connected to an eccentric clutch cam 85 so as to be operable to rotate the eccentric clutch cam 85 to and from a transmission disengagement position and a transmission engagement position. The eccentric clutch cam 85, in turn, is operatively connected to the clutch gear 80—so as to displace the clutch gear 80 from the clutch gear engaged position to the clutch gear disengaged position to disengage the drive geartrain 76 when the eccentric clutch cam 85 is rotated to the transmission disengagement position. The eccentric clutch cam 85 is further adapted and configured such that, when the eccentric clutch came is rotated to the transmission engagement position, the clutch gear 80 is permitted to move from the clutch gear disengaged position to the clutch gear engaged position to engage the drive geartrain 76. The clutch gear 80 is biased, such as by a suitable spring (not shown), in a direction from the clutch gear disengaged position toward the clutch gear engaged position as indicated by the arrow B in FIGS. 3 and 4, so as to return to the clutch gear engaged position when permitted to do so by rotation of the eccentric clutch cam 85 to the transmission engagement position.

As mentioned above, the unfolding springing apparatus 10 further comprises the electrical system 20. The electrical system 20 includes a suitable power supply 84 (illustrated schematically in FIG. 10 as a battery), a control board 86, a sensor 88, a light 90 (which may comprise, for example, a light emitting diode), and a sounder 92. The control board 86, sensor 88, light 90, and sounder 92 are operatively connected to the power supply 84, the sensor 88 being adapted and configured to detect an input signal and to transmit a sensor trigger signal to the control board 86 in response to detecting the input signal. The control board 86 is in turn adapted and configured to respond to the trigger signal by causing the drive geartrain 76 to be disengaged in response to receiving the sensor trigger signal from the sensor 88. In particular, the control board 86 causes the clutch motor 83 to be energized with current from the power supply 84 to rotate the clutch cam 85 to the transmission disengagement position, to disengage the drive geartrain 76.

Optionally, the electrical system 20 may include any suitable wired manual trigger (not shown), either in lieu of or in addition to the sensor 88, operable by a user to manually initiate transmission of the sensor trigger signal to the control board 86. A wired manual trigger may, for example, be a footpad (not shown) wrapped in a soft vinyl housing, which transmits vibrations generated by a user stepping on the footpad as a sound signal to a sound sensor associated with the control board 86, where the sound sensor thus signaled by the footpad may comprise the sensor 88 or an additional or alternative sensor not shown. Other suitable manual triggers may include a hand-operated switch, such as a contact switch or a button.

When the apparatus linkage is in the unfolded position (at some point after it is fully unfolded), the control board 86 is further adapted and configured to then cause the transmission to be engaged, by energizing the clutch motor 83 with current from the power supply 84 to rotate the clutch cam 85 to the transmission engagement position, to energize the drive motor 74 with current from the power supply 84 to displace the drive motor 74, to cause the drive geartrain 76 to transmit displacement from the drive motor 74 to the apparatus linkage 14, to cause the apparatus linkage 14 to articulate in the folding direction from the unfolded position to the folded position, and to cease the supply of energizing current from the power supply 84 to the drive motor 74 when the apparatus linkage 14 reaches the folded position. In addition, in response to the trigger signal the control board 86 is further adapted and configured to energize the light 90 and the sounder 92 with current from the power supply 84, to cause the light 90 and the sounder 92 to produce light and sound effects, such that the light and sound effects coordinate as desired with the movement and position of the prop P, as determined by the articulation of the apparatus linkage 14. Preferably, the light and sound effects are visible and audible to a person of normal, unaided vision and hearing, at a distance of 10 feet, and more preferably at a distance of 100 feet, from the unfolding springing apparatus 10.

The sensor 88 may be adapted and configured to detect any of a variety of suitable input signals as appropriate for a desired application of the unfolding springing apparatus 10. For example, the sensor 88 may be a "human sensor" that is operative to detect a passive infrared radiation (PIR) signal emitted from a person near the sensor 88, so as to surprise the person by triggering the unfolding springing apparatus 10 as the person approaches. In other embodiments, the sensor 88 may be operative to detect an audible sound signal, a visible light signal, a powered infrared signal emitted by a remote control, or a radio frequency signal. For example, the sensor 88 may be adapted and configured to detect a Bluetooth® Low Energy or Bluetooth® Classic signal (or equivalent UHF radio signal) emitted by a user's personal electronic device. Thus, for example, a human user may trigger the unfolding springing apparatus 10 from the user's smartphone or tablet.

Figure 12:
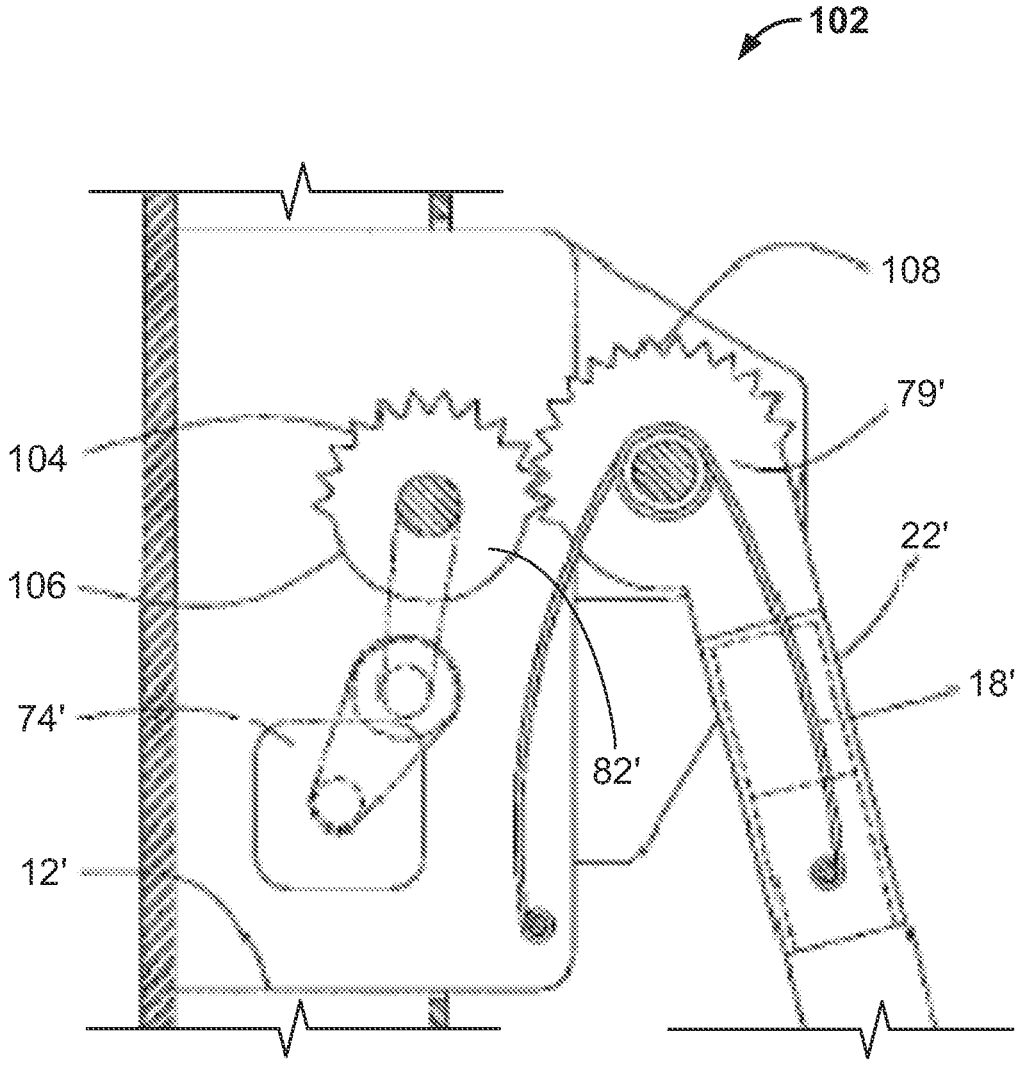
FIG. 12 is a truncated side elevation view of an embodiment of a transmission of an unfolding springing apparatus in a folded state.
Figure 13:
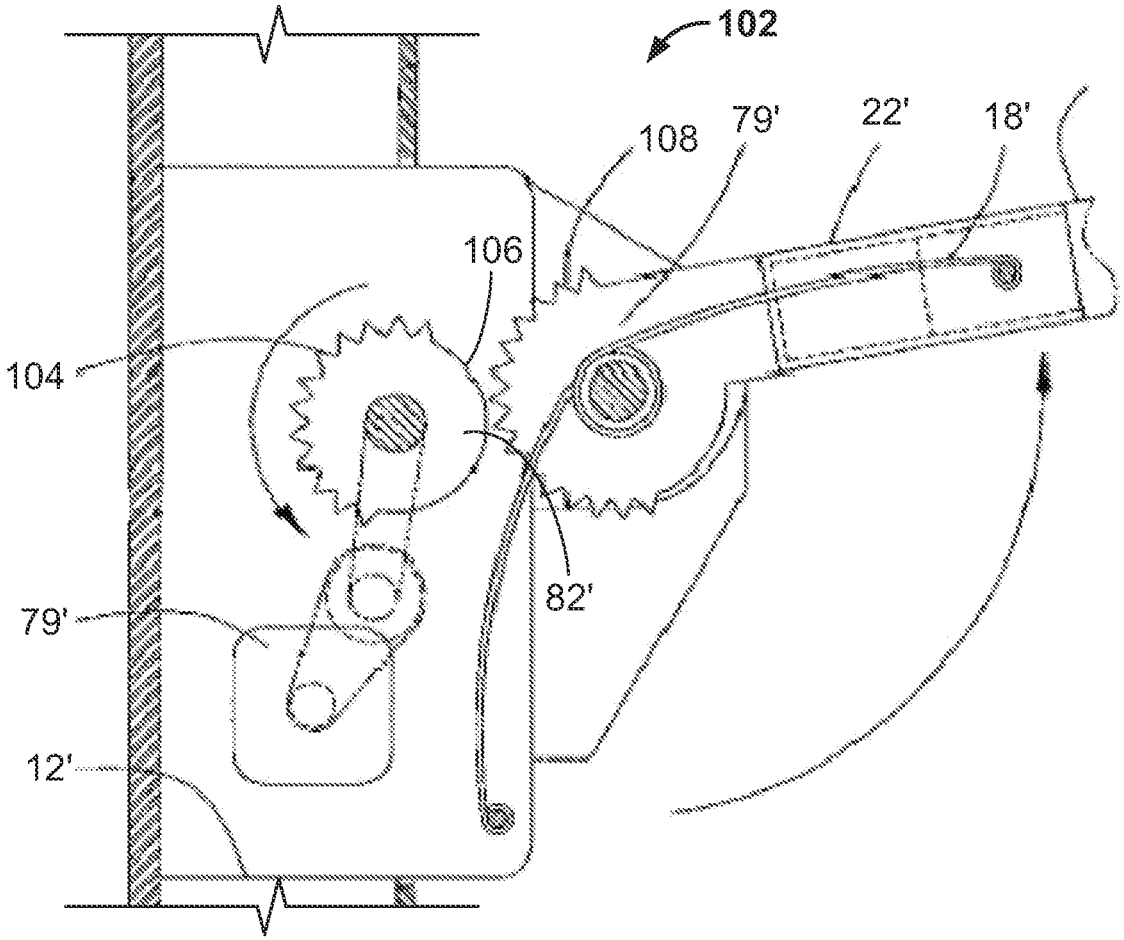
FIG. 13 is an illustration of the transmission of FIG. 12 springing to an unfolded state.
Figure 14:
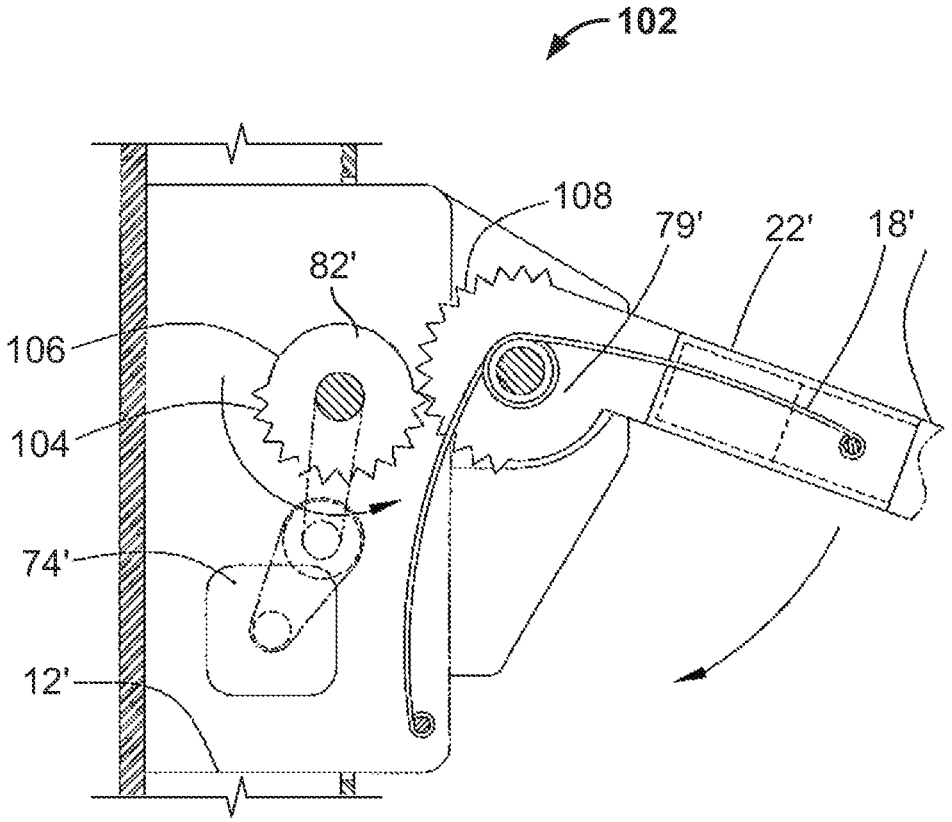
FIG. 14 is an illustration of the transmission of FIG. 12 being driven back to a folded state.

Illustrated in FIGS. 12-14 is a transmission 102 according to another embodiment of an unfolding springing apparatus. The transmission 102 includes a drive motor 74' mounted to a base 12', a drive wheel 82', and a driven wheel 79'. The drive wheel 82' has a circumference, the circumference having an engagement portion 104 with drive teeth distributed circumferentially therealong, and a disengagement portion 106 that is devoid of the drive teeth. The drive wheel 82' is operatively connected to the drive motor 74' to be rotated in a drive direction D (FIGS. 13 and 14) by the drive motor 74' when the drive motor is displaced. The driven wheel 79' is rotatably mounted to the base 12' and includes a plurality of driven teeth 108 adapted and configured to mesh with the drive teeth of the engagement portion 104 of the drive wheel 82' when the transmission 102 is engaged. Rotation of the drive wheel 82' driven by the drive motor 74' thus produces rotation of the driven wheel 79', the driven wheel 79' being operatively connected to an input crank 22', such that rotation of the driven wheel 79' causes the input crank 22' to pivot relative to the base 12' to cause an apparatus linkage to articulate from an unfolded position to a folded position, as illustrated in FIG. 14. When the apparatus linkage is in the folded position and the drive motor 74' is at rest, as shown in FIG. 12, engagement of the drive wheel engagement portion 104 with the driven teeth 108 of the driven wheel 79' holds the apparatus linkage in the folded position. Further rotation of the drive wheel 74' in the drive direction D from the position shown in FIG. 12 causes the drive wheel engagement portion 104 to lose contact with the driven teeth 108, to disengage the transmission 102 and permit the input crank 22' to rotate in the direction indicated in FIG. 14, thus allowing the apparatus linkage to articulate in the unfolding direction from the folded position to the unfolded position.

Also illustrated in FIGS. 12-14 is an unfolding spring 18' according to another embodiment of an unfolding springing apparatus. Instead of a tension spring connected between two links of an apparatus linkage, the unfolding spring 18' is a torsion spring connected between the base 12' and the input crank 22'. It will be understood that, instead of the linear tension helical springs illustrated as the unfolding spring 18, a torsion spring like the unfolding spring 18' could be similarly configured in the unfolding springing apparatus 10, centered at the first pivotal joint 38 and connected between the base 12 and the first crank 22, to provide a biasing torque to bias the first crank 22 to pivot in the unfolding direction relative to the base 12.

While the disclosed subject matter has been described with reference to certain embodiments, it is to be understood that the scope of the disclosed subject matter is capable of numerous changes, modifications and rearrangements, and such changes, modifications and rearrangements are intended to be covered by the following claims. In addition, although narrow claims may be presented below, it should be recognized that the scope of the disclosed subject matter is broader than presented by the claim(s). It is intended that broader claims may be submitted in one or more applications that claim the benefit of priority from this application. Insofar as the description above and the accompanying drawings disclose additional subject matter that is not within the scope of the claim or claims below, the additional subject matter is not dedicated to the public and the right to file one or more applications to claim such additional subject matter is reserved.

What is claimed is:

1. An unfolding springing apparatus, comprising:

a base, the base being adapted and configured to be supported on a support, the unfolding springing apparatus being adapted and configured to be supported by the base;

an apparatus linkage comprising a plurality of interconnected links, the apparatus linkage being articulable from a folded position to an unfolded position, the apparatus links comprising the base, a first crank, a second crank, a third crank, a fourth crank, a first coupler link, a second coupler link, and a third coupler link;

each of the first crank and the second crank being pivotally connected to each of the base and the first coupler link;

each of the first crank and the third crank being pivotally connected to each of the first coupler link and the second coupler link;

each of the third crank and the fourth crank being pivotally connected to each of the second coupler link and the third coupler link;

an unfolding spring, the unfolding spring being operatively connected between a pair of the apparatus links so as to bias the apparatus linkage to articulate in an unfolding direction from a folded position toward an unfolded position;

a drive motor, the drive motor being operatively connected between a first one of the links and a second one of the links;

a transmission, the transmission being operatively connected between the drive motor and the second one of the links and adapted and configured to be engageable when the apparatus linkage is in the unfolded position, when engaged, to transmit displacement from the drive motor to the second link, so as to move the second link relative to the first link, so as to cause the apparatus linkage to articulate in a folding direction from the unfolded position to the folded position, the transmission being adapted and configured to be disengageable when the apparatus linkage is in the folded position, and, when disengaged, to permit the apparatus linkage to articulate independently of the drive motor in the unfolding direction from the folded position to the unfolded position;

a prop mount, the prop mount being connected to the apparatus linkage such that at least the first crank and the second crank are connected between the base and the prop mount.

2. The unfolding springing apparatus of claim 1, further comprising the second crank being pivotally connected to the second coupler link, the fourth crank being pivotally connected to the first coupler link.

3. The unfolding springing apparatus of claim 1, wherein the apparatus linkage is adapted and configured to articulate only in a single plane of articulation.

4. The unfolding springing apparatus of claim 3, wherein the apparatus linkage plane of articulation is a vertical plane when the support is a horizontal surface, the base resting on the horizontal surface.

5. The unfolding springing apparatus of claim 1, further comprising a control board, a sensor, and a power supply, the control board and sensor being operatively connected to the power supply, the sensor being adapted and configured to detect an input signal and to transmit a sensor trigger signal to the control board in response to detecting the input signal, the control board being adapted and configured to cause the transmission to be disengaged in response to receiving the sensor trigger signal from the sensor, and when the apparatus linkage is in the unfolded position, to cause the transmission to be engaged, the drive motor to be displaced, and the transmission to transmit displacement from the drive motor to the apparatus linkage to cause the apparatus linkage to articulate in the folding direction from the unfolded position to the folded position.

6. The unfolding springing apparatus of claim 5, wherein the sensor is adapted and configured to detect as the input signal a signal selected from the group consisting of a passive infrared radiation signal emitted from a human near the sensor, a sound signal, a visible light signal, a powered infrared signal emitted by a remote control, and a radio frequency signal.

7. The unfolding springing apparatus of claim 5, further comprising a sounder, the control board being adapted and configured to cause the sounder to produce a sound when the input signal is detected by the sensor.

8. The unfolding springing apparatus of claim 5, further comprising a light source, the control board being adapted and configured to cause the light source to emit visible light when the input signal is detected by the sensor.

9. The unfolding springing apparatus of claim 1, wherein:

the first link is the base;

the second link is an input crank, the input crank being one of the first crank and the second crank;

the transmission includes a drive wheel, the drive wheel having a circumference, the circumference having an engagement portion with drive teeth distributed circumferentially therealong, the circumference having a disengagement portion that is devoid of the drive teeth, the drive wheel being operatively connected to the drive motor to be rotated in a drive direction by the drive motor when the drive motor is displaced, a driven wheel, the driven wheel being rotatably mounted to the base and including a plurality of driven teeth adapted and configured to mesh with the drive teeth of the drive wheel when the transmission is engaged, such that rotation of the drive wheel driven by the drive motor produces rotation of the driven wheel, the driven wheel being operatively connected to the input crank, such that rotation of the driven wheel causes the input crank to pivot relative to the base to cause the apparatus linkage to articulate from the unfolded position to the folded position, and such that when the apparatus linkage is in the folded position, further rotation of the drive wheel in the drive direction causes the engagement portion of the drive wheel to lose contact with the driven teeth, to disengage the transmission and permit the apparatus linkage to articulate in the unfolding direction from the folded position to the unfolded position.

10. The unfolding springing apparatus of claim 1, further comprising the transmission including an extension cylinder, an extension rod, and an output gear;

the extension cylinder being pivotally mounted to the base;

the extension rod having a length and a linear tooth rack comprising longitudinally distributed driven teeth, the extension rod being slidably connected to the extension cylinder to permit extension and retraction of the extension rod in opposed longitudinal extension and retraction directions, the extension rod having a proximal end disposed in the extension cylinder and a distal end pivotally connected to an input crank, the input crank being one of the first crank and the second crank, such that articulation of the apparatus linkage in the unfolding direction causes rotation of the input crank in an unfolding direction that produces extension of the extension rod, and such that retraction of the extension rod produces rotation of the input crank in a folding direction that causes the apparatus linkage to articulate in the folding direction;

the output gear being operatively connected to the drive motor to be rotated in a drive direction by the drive motor when the drive motor is displaced, the output gear having drive teeth that mesh with the driven teeth of the extension rod such that rotation of the output gear in a drive direction causes the extension rod to retract.

11. The unfolding springing apparatus of claim 1, further comprising:

the transmission including a drive geartrain and a clutch mechanism;

the drive geartrain comprising a plurality of drive gears that are adapted and configured to be meshed in series, the drive geartrain being operatively connected to the drive motor so that displacement of the drive motor in a drive direction causes rotation of the series drive gears in respective drive directions when the transmission is engaged, the series drive gears including an output gear and a clutch gear, the output gear being operatively connected to an input crank of the apparatus linkage, the input crank being one of the first crank and the second crank, such that rotation of the output gear in its respective drive direction causes the input crank to pivot in a folding direction that causes the apparatus linkage to articulate in the folding direction, the clutch gear being movably mounted to the apparatus with respect to the drive geartrain so as to permit displacement of the clutch gear relative to the drive geartrain to and from a disengaged position and an engaged position, wherein the transmission is engaged when the clutch gear is in the engaged position and disengaged when the clutch gear is in the disengaged position, wherein the clutch gear in the disengaged position is operatively disconnected from at least one of the drive motor and the input crank, so that the input crank is permitted to pivot independently of displacement of the drive motor when the clutch gear is in the disengaged position;

the clutch mechanism being operatively connected to the drive geartrain so as to be operable to displace the clutch gear to the disengaged position to disengage the transmission.

12. The unfolding springing apparatus of claim 11, wherein the clutch mechanism comprises a clutch motor and an eccentric clutch cam;

the clutch motor being operatively connected to the eccentric clutch cam so as to be operable to rotate the eccentric clutch cam to a transmission disengagement position and a transmission engagement position;

the eccentric clutch cam being operatively connected to the clutch gear so as to displace the clutch gear from the clutch gear engaged position to the clutch gear disengaged position to disengage the transmission when the eccentric clutch cam is rotated to the transmission disengagement position, and the eccentric clutch cam being adapted and configured to permit the clutch gear to move from the clutch gear disengaged position to the clutch gear engaged position to engage the transmission when the eccentric clutch cam is rotated to the transmission engagement position.

13. An unfolding springing apparatus, comprising:

a base, the base being adapted and configured to be supported on a support, the unfolding springing apparatus being adapted and configured to be supported by the base;

an apparatus linkage, the apparatus linkage being articulable from a folded position to an unfolded position, the apparatus linkage comprising a first crank, a second crank, and a coupler link, each of the first crank and the second crank being pivotally connected to each of the base and the coupler link, an unfolding spring, the unfolding spring being operatively connected to the apparatus linkage so as to bias the apparatus linkage to articulate in an unfolding direction from a folded position toward an unfolded position;

a drive motor, the drive motor being operatively connected between a first one of the links and a second one of the links;

a transmission, the transmission being operatively connected between the drive motor and the second one of the links and adapted and configured to be engageable when the apparatus linkage is in the unfolded position, when engaged, to transmit displacement from the drive motor to the second link, so as to move the second link relative to the first link, so as to cause the apparatus linkage to articulate in a folding direction from the unfolded position to the folded position, the transmission being adapted and configured to be disengageable when the apparatus linkage is in the folded position, and, when disengaged, to permit the apparatus linkage to articulate independently of the drive motor in the unfolding springing direction from the folded position to the unfolded position;

a prop mount, the prop mount being connected to the apparatus linkage such that at least the first crank and the second crank are connected between the base and the prop mount;

the transmission including an extension cylinder, an extension rod, and an output gear;

the extension cylinder being pivotally mounted to the base;

the extension rod having a length and a linear tooth rack comprising longitudinally distributed driven teeth, the extension rod being slidably connected to the extension cylinder to permit movement of the extension rod relative to the extension cylinder in a first longitudinal direction and in a second longitudinal direction opposite to the first longitudinal direction, the extension rod having a proximal end disposed in the extension cylinder and a distal end pivotally connected to an input crank, the input crank being one of the first crank and the second crank, such that articulation of the apparatus linkage in the unfolding direction causes rotation of the input crank in an unfolding direction that causes movement of the extension rod in the first longitudinal direction, and such that movement of the extension rod in the second longitudinal direction produces rotation of the input crank in a folding direction that causes the apparatus linkage to articulate in the folding direction;

the output gear being operatively connected to the drive motor to be rotated in a drive direction by the drive motor when the drive motor is displaced, the output gear having drive teeth that mesh with the driven teeth of the extension rod such that rotation of the output gear in a drive direction causes the extension rod to move in the second longitudinal direction.

14. The unfolding springing apparatus of claim 13, wherein the first longitudinal direction is a direction in which the extension rod is adapted and configured to extend out of the extension cylinder, and the second longitudinal direction is a direction in which the extension rod is adapted and configured to retract into the extension cylinder.

15. An unfolding springing apparatus, comprising:

a base, the base being adapted and configured to be supported on a support, the unfolding springing apparatus being adapted and configured to be supported by the base;

an apparatus linkage, the apparatus linkage being articulable from a folded position to an unfolded position, the apparatus linkage comprising a first crank, a second crank, and a coupler link, each of the first crank and the second crank being pivotally connected to each of the base and the coupler link, an unfolding spring, the unfolding spring being operatively connected to the apparatus linkage so as to bias the apparatus linkage to articulate in an unfolding direction from a folded position toward an unfolded position;

a drive motor, the drive motor being operatively connected between a first one of the links and a second one of the links;

a transmission, the transmission being operatively connected between the drive motor and the second one of the links and adapted and configured to be engageable when the apparatus linkage is in the unfolded position, when engaged, to transmit displacement from the drive motor to the second link, so as to move the second link relative to the first link, so as to cause the apparatus linkage to articulate in a folding direction from the unfolded position to the folded position, the transmission being adapted and configured to be disengageable when the apparatus linkage is in the folded position, and, when disengaged, to permit the apparatus linkage to articulate independently of the drive motor in the unfolding springing direction from the folded position to the unfolded position;

a prop mount, the prop mount being connected to the apparatus linkage such that at least the first crank and the second crank are connected between the base and the prop mount;

the transmission including a drive geartrain and a clutch mechanism;

the drive geartrain comprising a plurality of drive gears that are adapted and configured to be meshed in series, the drive geartrain being operatively connected to the drive motor so that displacement of the drive motor in a drive direction causes rotation of the drive gears in respective drive directions when the transmission is engaged, the drive gears including an output gear and a clutch gear, the output gear being operatively connected to an input crank of the apparatus linkage, the input crank being one of the first crank and the second crank, such that rotation of the output gear in its respective drive direction causes the input crank to pivot in a folding direction that causes the apparatus linkage to articulate in the folding direction, the clutch gear being movably connected to the drive geartrain to permit displacement of the clutch gear relative to the drive geartrain to and from a disengaged position and an engaged position, wherein the transmission is engaged when the clutch gear is in the engaged position and disengaged when the clutch gear is in the disengaged position, wherein the clutch gear in the disengaged position is unmeshed from at least one gear with which the clutch gear is meshed when in the engaged position, so that at least the output gear is permitted to rotate independently of displacement of the drive motor when the clutch gear is in the disengaged position;

the clutch mechanism being operatively connected to the drive geartrain so as to be operable to displace the clutch gear to the disengaged position to disengage the transmission.

16. The unfolding springing apparatus of claim 15, wherein the clutch mechanism comprises a clutch motor and an eccentric clutch cam;

the clutch motor being operatively connected to the eccentric clutch cam so as to be operable to rotate the eccentric clutch cam to a transmission disengagement position and a transmission engagement position;

the eccentric clutch cam being operatively connected to the clutch gear so as to displace the clutch gear from the clutch gear engaged position to the clutch gear disengaged position to disengage the transmission when the eccentric clutch cam is rotated to the transmission disengagement position, and the eccentric clutch cam being adapted and configured to permit the clutch gear to move from the clutch gear disengaged position to the clutch gear engaged position to engage the transmission when the eccentric clutch cam is rotated to the transmission engagement position.

* * * * *